US008651287B2

(12) United States Patent
Moser et al.

(10) Patent No.: US 8,651,287 B2
(45) Date of Patent: Feb. 18, 2014

(54) CROCKERY BASKET FOR RECEIVING CROCKERY IN A VARIABLE MANNER

(75) Inventors: Hermann Moser, Altenmuenster (DE); Bernd Schessl, Dillingen/Donau (DE); Rainer Schuetz, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 11/658,246

(22) PCT Filed: Jul. 20, 2005

(86) PCT No.: PCT/EP2005/053504

§ 371 (c)(1),
(2), (4) Date: Jan. 22, 2007

(87) PCT Pub. No.: WO2006/015932

PCT Pub. Date: Feb. 16, 2006

(65) Prior Publication Data

US 2008/0302740 A1 Dec. 11, 2008

(30) Foreign Application Priority Data

Jul. 23, 2004 (DE) ..... 10 2004 035 726

(51) Int. Cl.
*A47L 15/50* (2006.01)

(52) U.S. Cl.
USPC ..... 211/41.8; 211/175; 211/195

(58) Field of Classification Search
USPC ..... 211/41.3–41.9, 181.1, 195, 126.6, 211/130.1, 132.1, 175; 134/56 D, 201, 200, 134/144, 135; 220/488, 531; 312/311, 312, 312/339, 350, 351
See application file for complete search history.

(56) References Cited

U.S. PATENT DOCUMENTS 2,479,118 A * 8/1949 Jenness ..... 211/41.5
2,516,088 A * 7/1950 Einhorn ..... 211/41.5

(Continued)

FOREIGN PATENT DOCUMENTS

DE 88 11 474 U 11/1988
DE 197 55 339 6/1998

(Continued)

OTHER PUBLICATIONS

International Search Report PCT/EP2005/053504.

(Continued)

*Primary Examiner* — Jennifer E Novosad
(74) *Attorney, Agent, or Firm* — James E. Howard; Andre Pallapies

(57) ABSTRACT

A crockery basket is provided for receiving a plurality of different types of crockery, especially in a dishwasher machine, said basket comprising a grid-type holding device consisting of a plurality of prongs that can be pivoted between different pivoting positions. The holding device consists of at least two pivoting rows of prongs that can be independently pivoted between the different pivoting positions.

24 Claims, 5 Drawing Sheets

(56) References Cited

U.S. PATENT DOCUMENTS

| | | | | | |
|---|---|---|---|---|---|
| 3,752,322 | A * | 8/1973 | Fiocca et al. | 211/41.8 |
| 4,046,261 | A * | 9/1977 | Yake | 211/41.8 |
| 4,169,638 | A * | 10/1979 | Cirasuolo et al. | 312/229 |
| 4,606,464 | A | 8/1986 | Jordan et al. | |
| 4,917,248 | A * | 4/1990 | Friskney | 211/41.8 |
| 5,158,185 | A | 10/1992 | Michael et al. | |
| 5,351,837 | A * | 10/1994 | Smith | 211/41.8 |
| 5,480,035 | A * | 1/1996 | Smith | 211/41.8 |
| 5,601,195 | A * | 2/1997 | Finola et al. | 211/41.8 |
| 5,649,630 | A * | 7/1997 | Remmler | 211/41.8 |
| 6,546,942 | B2 * | 4/2003 | Smith et al. | 134/201 |
| 6,571,965 | B1 * | 6/2003 | Beck et al. | 211/41.8 |
| 2001/0045401 | A1 | 11/2001 | Deiss | |
| 2006/0237379 | A1 * | 10/2006 | Yang et al. | 211/41.4 |
| 2006/0289038 | A1 * | 12/2006 | Hedstrom et al. | 134/25.2 |
| 2007/0039904 | A1 * | 2/2007 | Purushothaman | 211/41.8 |
| 2008/0083678 | A1 * | 4/2008 | Graute | 211/41.8 |

FOREIGN PATENT DOCUMENTS

| | | |
|---|---|---|
| DE | 199 47 152 | 4/2001 |
| DE | 201 04 114 U | 5/2001 |
| DE | 102 04 692 | 8/2003 |
| EP | 0 729 725 | 9/1996 |
| EP | 0 797 949 | 10/1997 |
| GB | 1 393 054 | 5/1975 |
| JP | 6-217921 | 8/1994 |
| WO | WO 01/87133 | 11/2001 |

OTHER PUBLICATIONS

Report of Examination DE 10 2004 035 726.9 mailed Mar. 14, 2013.

* cited by examiner

CROCKERY BASKET FOR RECEIVING CROCKERY IN A VARIABLE MANNER

The invention relates to a crockery basket for receiving crockery, particularly in a dishwasher machine, with a grid-type holding device consisting of a plurality of prongs, which device can be folded between different swivel positions. The device also relates to a dishwasher machine with a crockery basket.

BACKGROUND OF THE INVENTION

Crockery baskets for receiving kitchen ware such as plates, cups, glasses etc., for use in dishwasher machines, particularly domestic dishwasher machines, are widely known. The object of the design of crockery baskets is to offer the user maximum flexibility in filling the crockery basket. The intention is therefore to be able to arrange crockery of varying dimensions, e.g. plates and bowls of differing depth, comfortably in a crockery basket making optimum use of the space available. A number of suggestions have been made for creating this flexibility.

DE 88 11 474 U discloses a crockery basket for a domestic dishwasher machine with a grid-type holding device consisting of interconnecting prongs. Here the holding device is pivotably mounted about a horizontal axis between different positions. Parts which serve as dish stops for preventing cups or similar small crockery from sliding off are formed on the holding device perpendicular to the axis of pivoting and parts projecting from both sides of a supporting surface of the holding device. The pivoting of the holding device between different positions provides the desired more flexible use of the crockery basket.

DE 198 57 104 A1 discloses a further developed crockery basket in which the prongs of a holding device that can be pivoted between different positions are designed so that they angled at their lower ends facing the crockery basket. This enables crockery, particularly hollow bodied crockery—with a depth greater than plates—also to be received in the crockery basket. The receiving capacity of the crockery basket may be used more flexibly without other devices being installed in the crockery basket for this purpose or without having to remove them when not in use.

Particularly high flexibility is achieved in a variant in which only every second prong of a plurality of prongs of a holding device in a row of prongs is designed angled at its lower end in order to act as a stop for retaining wider hollow bodied crockery. Such a stop can then be retained between two stops when the holding device is laid flat, the distance between the two stops being twice that in the upright row of folding prongs set upright. The disadvantage of the disk rack described is that a flat surface cannot be provided.

Another solution or the flexible receiving of crockery of varying depth is proposed in EP 0 729 725 A1. This relates to an insert that can be inserted in a crockery basket with a pair of rotary wire brackets by means of which the dish holder can be offset in different configurations. The rotary holding devices are offset against each other in the longitudinal direction on parallel rotary detaining wires. The prongs are in this manner arranged equidistant from each other in the longitudinal direction. By twisting of the two holding devices into an "open" position, the distance between two prongs of the dish holder is doubled. The disadvantage of the arrangement described in EP 0 729 725 A1 consists in the fact that due to the pivoting of one or both holding devices the prong ends of the pivoted holding device stand upwards in the crockery basket and occupy a space lying adjacent to the dish holder.

The result of this is that only insufficient flexibility can be achieved in the crockery basket.

SUMMARY OF THE INVENTION

The object of this invention is therefore to indicate a possibility of achieving the maximum possible flexibility in a crockery basket for receiving a plurality of different items of crockery, in particular in a dishwasher machine, thus providing the user with optimum handleability. In particular, a possibility should be provided enabling crockery of differing depth to be arranged with optimum use of space.

This object is achieved according to the invention by a crockery basket with the features of the exemplary embodiments described herein.

Starting with a crockery basket with a grid-type holding device, consisting of a plurality of prongs which can be folded between different pivoting positions, the holding device is formed according to the object of the invention from at least two rows of folding prongs which can be folded independently between the different pivoting positions. In a first pivoting position the prongs of both rows of folding prongs are aligned approximately vertically and are arranged in a row so that a short distance is formed between two folding prongs lying on a longitudinal axis for retaining flat crockery, e.g. plates. In a second pivoting position one of the rows of folding prongs is folded down so that its prongs come to lie approximately horizontally above the wire mat of the crockery basket. Consequently a greater distance is formed by the prongs of the other row of folding prongs still remaining in the vertical or first pivoting position, which distance depends on the arrangement of the prongs in the other row of folding prongs. In a third pivoting position both rows of folding prongs are folded down so that they come to lie in an approximately vertical arrangement above the wire mat of the crockery basket. In order to be able to retain crockery in the arrangement of prior art in the crockery basket according to the invention, a total of two holding devices according to the design described above may be required.

Because of the division of a holding device according to the invention into two rows of folding prongs, crockery of varying depth, e.g. flat plates, soup plates, bowls and the like can be received by simple, low cost means in the holding device. If the holding device has been brought into the third pivoting position, an essentially flat surface is provided so that the crockery basket can be used for receiving pots, pans or large crockery. Here folding down the rows of folding prongs reliably prevents the distortion of individual prongs in comparison to a fixed arrangement. One major advantage of at least two rows of folding prongs in a holding device consists in the fact that despite high flexibility, no device need be installed in the crockery basket and removed again when not required.

Each row of folding prongs preferably has its own axis of rotation. According to one embodiment the axes of rotation of the rows of folding prongs are displaced relative to each other in the vertical direction. Here it is particularly advantageous for the axis of rotation of one of the rows of folding prongs to be arranged above the wire mat of the crockery basket and for the axis of rotation of the other row of folding prongs to be arranged underneath the wire mat of the crockery basket. When the rows of folding prongs are folded down into the third pivoting position, this provides an extremely flat surface at the bottom of the crockery basket.

An extremely simple mechanical design of the holding device is obtained when the axes of rotation of the rows of folding prongs are offset relative to each other in the horizontal direction.

According to a further embodiment the holding device, consisting of the at least two rows of folding prongs, is mounted on at least one lateral stay defining a lateral wall of the crockery basket. The holding device can be supported by suitable design of the lateral wall of the crockery basket. It is particularly advantageous for a bearing plate to be provided as a support or bearing for each holding device, which plate is detachably connected to the lateral wall of the crockery basket. The bearing plate or plates are preferably manufactured from a plastic because the desired shape can easily be obtained by means of an injection moulding process.

The support plate has, in one embodiment, a number of bearing bushes lying in a respective axis of rotation corresponding to the number of rows of folding prongs, which bushes are formed on the support plate and are used to receive bearing journals lying in the axis of rotation. The support plate preferably also has at least one stopping means which form or forms stops for limiting the pivoting angle for parts of a folding prong row. Here it is preferable for the stopping means also to be formed on the support plate or connected positively or non-positively to it.

A stop nose is preferably provided as a stopping means in the support plate for each row of folded prongs, guaranteeing secure, solid fixing of each row of folding prongs in a first pivoting position in which the prongs of each row of folding prongs are aligned essentially vertically. Further stop noses may also be used to fix the folding prong rows in one of the further pivoting positions or to define at least one stop so that further pivoting is no longer possible.

According to a further advantageous embodiment the prongs of a folding prong row have a curvature so that the prongs of all the folding prong rows come to lie along the axis of rotation in one line and alignment in the first pivoting position in which they stand essentially perpendicularly upwards. Here the curvature is dimensioned so that it allows for the distances between the respective axes of rotation of the folding prong rows.

It is also preferable for the prongs of each of the folding prong rows to be each spaced regularly apart and for the prongs of each of the folding prong rows to be arranged alternately and equidistantly to each other. If a holding device has exactly two folding prong rows, the distance between two consecutive prongs may be doubled in the second pivoting position relative to the first pivoting position. On the other hand, there is a uniform division throughout the length of the holding device in the first pivoting position.

In a further advantageous embodiment provision is made for each holding device to be assigned to a bearing plate in order to retain the folding prong rows of the holding device and limit the pivoting angle.

According to a special embodiment the holding device may be formed above the inner length of the crockery basket. It is also conceivable for the holding device to be divided over the inner length into a first and a second holding device, each with at least two folding prong rows which can be folded independently of each other between the different pivoting positions. The division of the holding device, preferably in the centre of the crockery basket, provides even greater flexibility when loading in the crockery. For example, whilst the holding devices in the front region of the crockery basket can be displaced into the third pivoting position in order to fit small pots, for example, in the essentially flat area now created, the folding prong rows of the holding device in the rear section may remain in the first pivoting position so that a multiplicity of small, flat plats can be loaded in.

The crockery basket according to the invention may be arranged either as a lower basket or as an upper basket in a dishwasher machine.

A dishwasher machine, in particular a domestic dishwasher machine, with a crockery basket of the type described, provides the possibility of flexible receiving of crockery, either for a multiplicity of flat crockery or a smaller number of deeper crockery or by providing a flat surface for extremely large, bulbous crockery.

BRIEF DESCRIPTION OF THE DRAWINGS

Further advantages, expediencies and embodiments of the invention are described in greater detail in the following with reference to the figures.

The same components are represented in the following figures with the same reference numbers. The components shown in the figures do not correspond to their actual size and are only shown enlarged or reduced for the purposes of a clearer explanation.

DETAILED DESCRIPTION OF THE EXEMPLARY EMBODIMENTS OF THE PRESENT INVENTION

A preferred embodiment of a crockery basket according to the invention is described in the following with reference to FIGS. 1 to 4.

Figure 1:
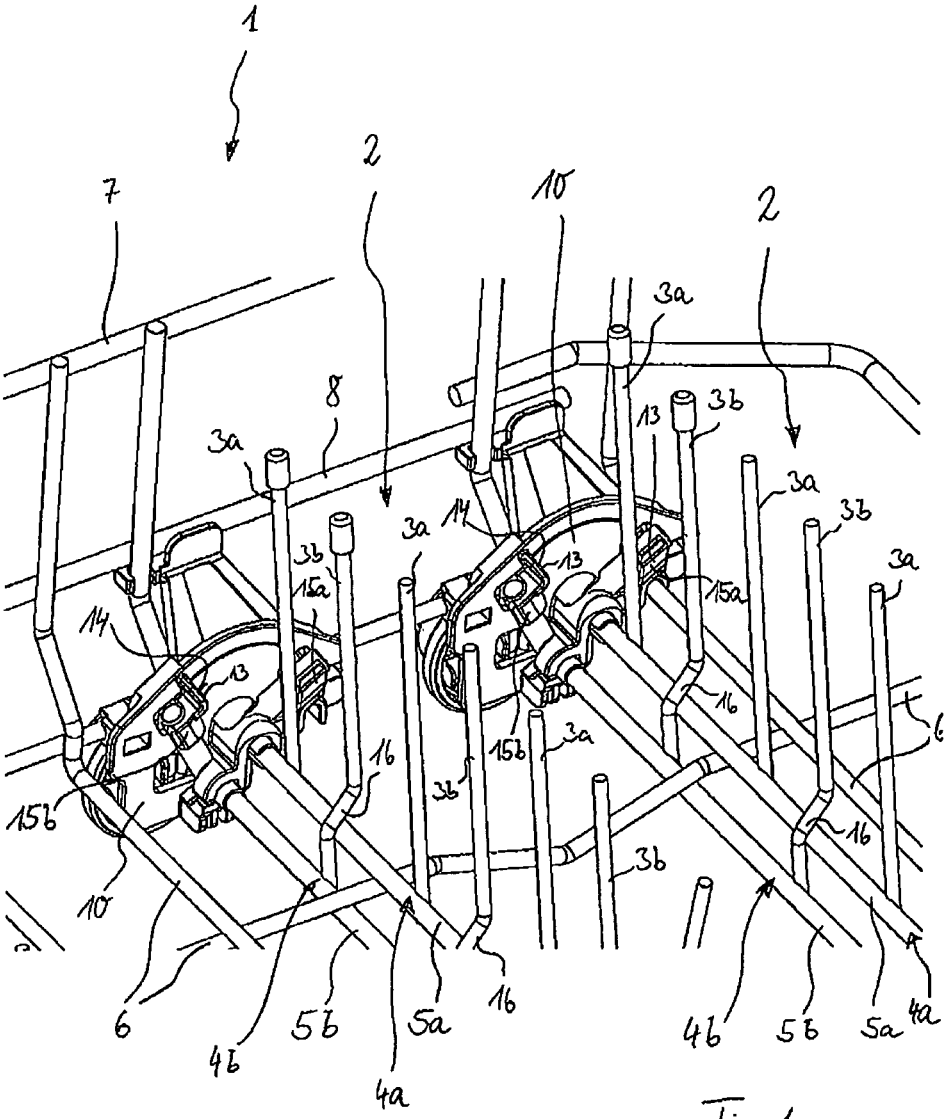
FIG. 1 shows a section of a crockery basket in a perspective view with two holding devices, each of which comprises two folding prong rows, each of which are installed to receive a multiplicity of shallow crockery.

FIG. 1 shows a section of a crockery basket 1 according to the invention in a perspective view. Two holding devices 2 are shown, each of which has, for example, two folding prong rows 4*a*, 4*b*. Each folding prong row 4*a* has prongs 3*a* arranged equidistantly from each other, which prongs run in a straight line and are fastened to a wire part 5*a*. They may be fastened by any means. Each of the folding prong rows 4*b* has a multiplicity of prongs 3*b* arranged equidistantly form each other, which prongs are fastened to a wire part 5*b*.

In order to be able to obtain the first swivel position, shown in FIG. 1, in which folding prong rows 4*a*, 4*b* of each holding device 2 is installed, i.e. arranged approximately perpendicularly to the bottom of the crockery basket, prongs 3*b* of each folding prong row 4*b* have a curvature 16. According to this exemplary embodiment the axis of rotation of folding prong row 4*a* runs above a wire mat 6 of the crockery basket, whilst the axis of rotation of the other folding prong row 4*b* is arranged underneath wire mat 6 of crockery basket 1. Combined with the curvature of prongs 3*b*, this provides a particularly flat surface of the crockery basket when the folding prong rows are brought into their horizontal position.

Prongs 3*a* of folding prong row 4*a* are arranged at the same distance from each other as prongs 3*b* of a folding prong row 4*b*. Folding prong rows 4*a*, 4*b* are aligned with each other so that the same distance is obtained between adjacent prongs in the first pivoting position of both folding prong rows 4*a*, 4*b*. In this position the crockery basket is arranged to receive a multiplicity of flat crockery.

Figure 2:
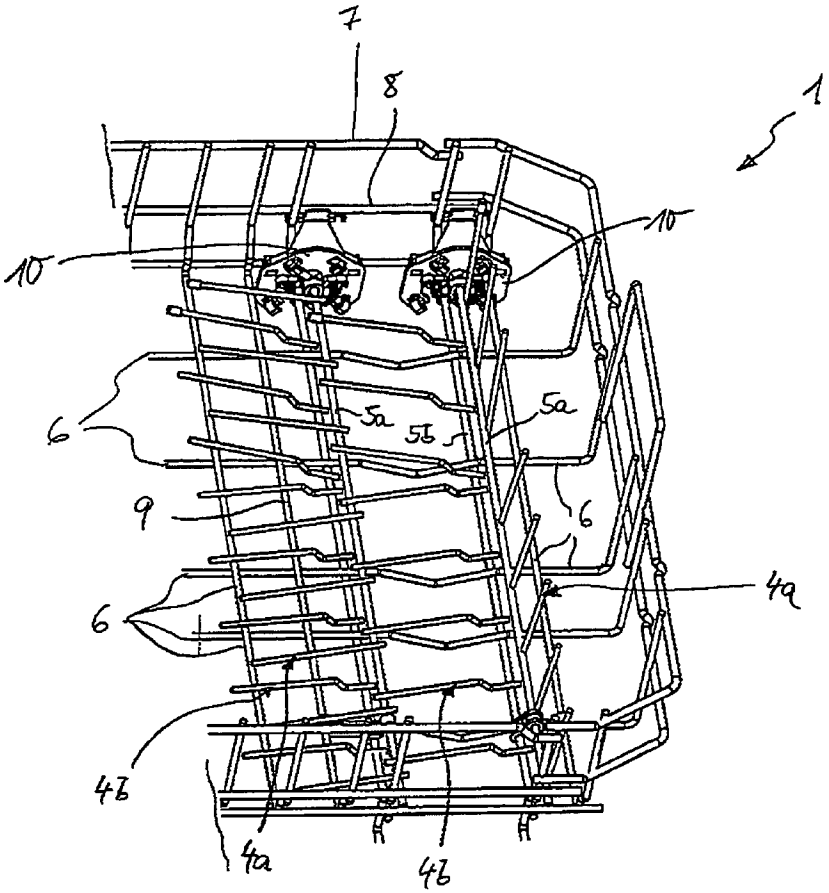
FIG. 2 shows another section of the crockery basket in a perspective view with two holding devices, each of which comprises two folding prong rows, the figure showing the handling of the folding prong rows.
Figure 3:
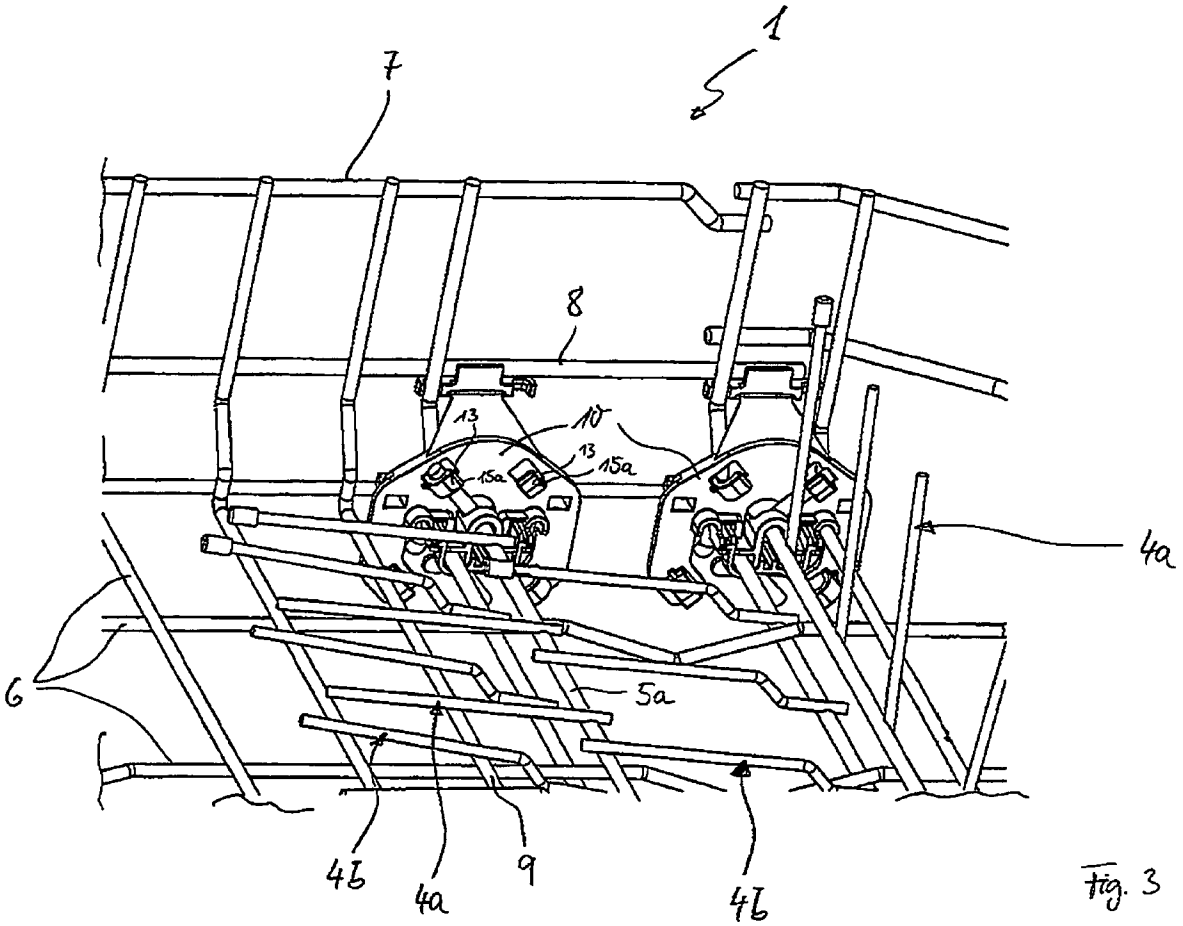
FIG. 3 shows an enlarged view of the crockery basket in FIG. 2 indicating the mounting of the folding prong rows of a holding device, each on a support plate.

Extremely high flexibility is achieved when loading the crockery basket in that each of folding prong rows 4*a*, 4*b* of each of holding devices 2 can be repositioned separately from each other. This is shown more clearly in FIGS. 2 and 3, FIG. 3 showing an enlarged view of the crockery basket in FIG. 2, so that the mounting of the folding prong rows on support plates 10 is seen more clearly. Whilst in FIGS. 2 and 3 folding prong rows 4*a*, 4*b* placed on the left side of the observer are brought into a third pivoting position, in which both folding prong rows are folded over and therefore come to lie on wire mat 6 (the bottom of crockery basket 1), only folding prong row 4*b* is folded onto the bottom of the crockery basket in the holding device located on the right side of the observer, whilst folding prong row 4*a* remains in its upright position.

An essentially flat surface is created in crockery basket 1 by folding over the folding prong rows completely so that the basket is suitable, for example, for receiving bulky crockery. If only one folding prong row is folded over, the distance between two prongs of the folding prong row still upright is doubled in this exemplary embodiment, so that glasses or crockery with a comparatively greater depth can be received, for example.

The separate folding over of the folding prong rows of a holding device requires a special geometry of the folding prong rows and a special mounting. The division of a holding device is achieved by two separate axes of rotation for each of the folding prong rows, two separate support points and means for retaining the different prong positions for a folding prong row. The folding prong rows are supported by means of support plate 10. One support plate 10 is provided here for each holding device 2. Support plate 10 preferably consists of a plastic material and is detachably connected to crockery basket 1. More precisely, support plates 10 are each connected to a lateral wall 7 of crockery basket 1 and are supported on one or more lateral stays 8 of the crockery basket.

Figure 5:
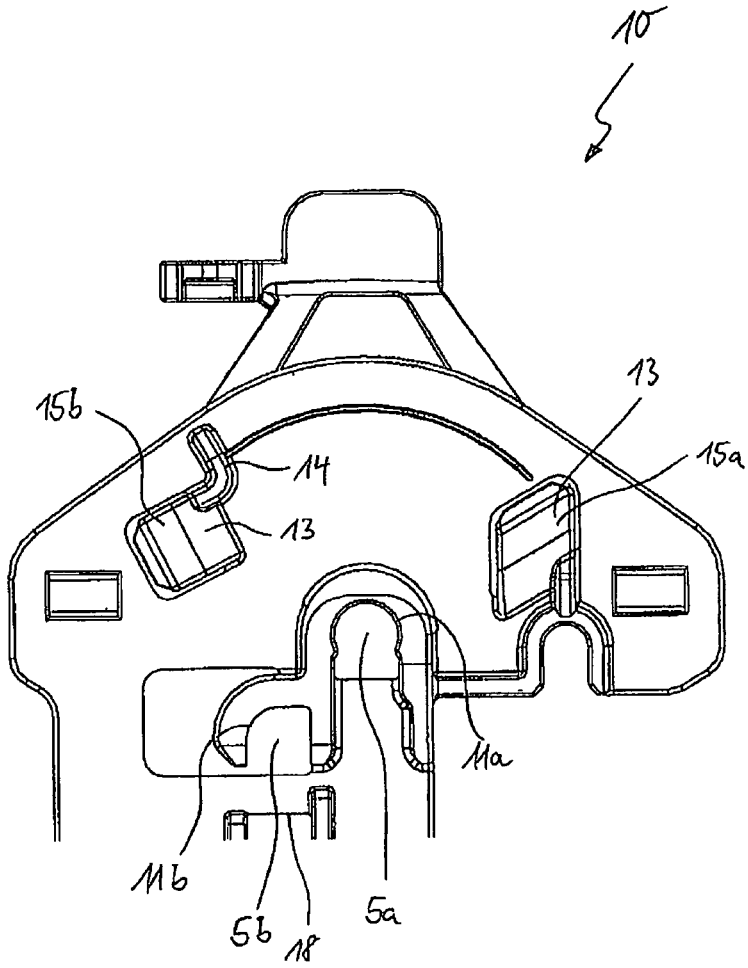
FIG. 5 shows a support plate for supporting the folding prong rows of a holding device.

An exemplary embodiment of a support plate 10 is shown in FIG. 5. Each support plate has two bearing bushes 11*a*, 11*b* separated horizontally and vertically from each other, into which bushes engage corresponding bearing journals of the folding prong rows. Here the bearing bushes are in line with the respective axes of rotation of the folding prong rows, which are formed by wire parts 5*a*, 5*b* of a respective folding prong row 4*a*, 4*b*. Bearing bushes 11*a*, 11*b* may in principle be of any structural design. Bearing bush 11*a*, for example, has a segment-like section through which the bearing journal of a folding prong row can be inserted. After the bearing journal is "pressed in" the folding prong row can be mounted rotatably in bearing bush 11*a*. Bearing bush 11*b* requires a further component for supporting the folding prong row, which component is not shown in FIG. 5, and which is pressed into recess 18 in order to effect the support of the folding prong row in bearing bush 11*b*.

In order to be able to arrange prongs 3*a*, 3*b* of folding prong rows 4*a*, 4*b* in the first pivoting position in a row, aligned equidistantly from each other, prongs 3*b* of folding prong rows 4*b* have a curvature 16 in order to be able to compensate for the different positioning of the axes of rotation. This is most clearly seen in the side view in FIG. 4, which shows the arrangement and design of the folding prong rows relatively to each other and to the support plate.

Figure 4:
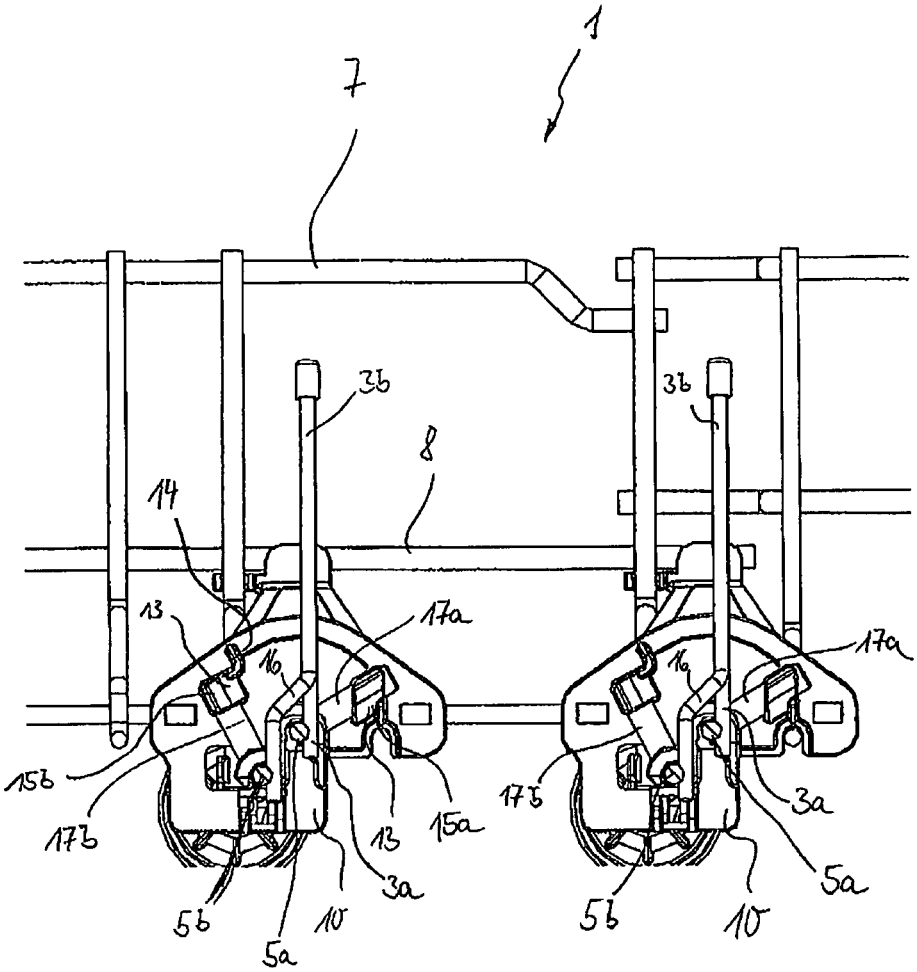
FIG. 4 shows the arrangement and design of the folding prong rows relative to each other in a side view.

In order to fix the folding prong rows in their vertical or horizontal position, each of support plates 10 has a plurality of stop means 13. Stop means 13 are on the one hand designed in the form of a stop nose 15*a* for folding prong row 4*a*, and in the form of a stop nose 15*b* for folding prong row 4*b*. Furthermore, a stop 14 is formed on stop nose 15*b*. Stop 14 is here assigned to folding prong row 4*a*. FIGS. 1 and 4 most clearly show that each of wire parts 5*a*, 5*b* of each folding prong row 4*a*, 4*b* has a holding part 17*a*, 17*b* which is fastened to wire part 5*a*, 5*b*. In the first pivoting position holding part 17*a* engages in stop nose 15*a*, so that folding prong row 4*a* is protected from inadvertent pivoting. Correspondingly holding part 17*b* engages in stop nose 15*b*, thus folding prong row 4*b* is also prevented from inadvertent pivoting.

A folding prong row is twisted by actuating one of the prongs of a folding prong row. After the resistance generated by the suitably shaped stop noses 15*a*, 15*b* has been overcome, each of folding prong rows 4*a*, 4*b* can be pivoted into a horizontal position. Here prongs 3*b* of a folding prong row 4*b* come to lie either on wire part 5*a* of the adjacent holding device or on wire stay of wire mat 6, so that no separate stop need be formed on support plate 10 for holding part 17*b*. On the other hand, no such support is available for folding prong row 4*a*, in particular for the holding device arranged on the right in the figure, which is why holding part 17*a* rests on stop 14 in the horizontal alignment of folding prong row 4*a*. Folding prong row 4*a* is not therefore supported by parts of crockery basket 1 but by stop 14. This is seen particularly clearly in the representation in FIG. 3.

Whilst support plate 10 in FIG. 5 only has one stop 14 on which holding part 17*a* can be supported, the support plates according to the exemplary embodiments in FIGS. 1 to 3 are designed so that holding part 17*a* engages in a stop nose even in the horizontal pivoting position. Here the design may be any that can be conceived by the person skilled in the art. Stop means 13 for fixing folding prong row 4*b* need not be arranged on the side facing the inside of the crockery basket either, but may instead also be realised on the side facing the outside.

In the exemplary embodiments shown in the figures each holding device has two folding prong rows, each with prongs spaced equidistantly apart. Of course it is also conceivable for a holding device to have more than the two folding prong rows shown. A separate axis of rotation is then provided for each folding prong row, as described in the examples.

As seen in FIG. 2, the holding device is designed according to the exemplary embodiment described so that it runs throughout the inner width of the crockery basket. It would also be conceivable to divide the parallel running holding devices, e.g. in the centre, so that a total of four independent holding devices are arranged over the inner width of the crockery basket. Each of the holding devices could then have a plurality of folding prong rows according to the above description. Consideration would have to be given in the design to the fact that one support plate must be provided for each of the holding devices to support and guide the folding prong rows.

The advantage of the invention is that further, flexible adjusting possibilities can be provided for plates of different depth and for crockery with an unfavourable geometry by folding away folding prong rows. By actuating one or more folding prong rows narrow or wide storage spaces may be provided. By folding over all the folding prong rows a crockery basket with an essentially flat surface is provided, e.g. for pots and pans. The folding prong rows can be actuated without additional actuating elements, ensuring optimum use of the space available in a crockery basket. The operation for a user remains simple because the holding device or folding prongs remain in the crockery basket and need not be removed from the crockery basket for any situation of use.

LIST OF REFERENCE NUMBERS

1 Crockery basket
2 Holding device
3*a*, 3*b* Prongs
4*a*, 4*b* Folding prong row
5*a*, 5*b* Wire part
6 Wire mat
7 Lateral wall
8 Lateral stay
9 Wire stay
10 Bearing plate
11*a*, 11*b* Bearing bush
12*a*, 12*b* Bearing journal
13 Support means
14 Stop
15*a*, 15*b* Stop nose
16 Curvature
17*a*, 17*b* Holding part
181 Recess

The invention claimed is:

1. A crockery basket for receiving a plurality of different items of crockery for handling of such crockery in a dishwasher machine, the crockery basket comprising:

a wire mat forming a bottom of the crockery basket, the wire mat having a wire with a longitudinal extent;

a holding device mounted on the longitudinal extent of the wire of the wire mat, the holding device having a plurality of prongs, the holding device being foldable between different pivoting positions and having at least two folding prong rows, each of the at least two folding prong rows being folded independently of each other between different pivoting positions, the at least two folding prong rows including:

a first folding prong row mounted on a first part of the longitudinal extent of the wire; and a second folding prong row mounted on a second part of the longitudinal extent of the wire, wherein a first axis of rotation of the first folding prong row of the at least two folding prong rows is arranged directly above the first part of the longitudinal extent of the wire relative to the vertical direction, wherein a second axis of rotation of the second folding prong row of the at least two folding prong rows is arranged directly below the second part of the longitudinal extent of the wire relative to the vertical direction, and wherein the first axis of rotation and the second axis of rotation are disposed on opposite sides of the longitudinal extent of the wire of the wire mat from each other relative to the vertical direction.

2. The crockery basket according to claim 1, wherein each folding prong row of the at least two folding prong rows has its own axis of rotation.

3. The crockery basket according to claim 2, wherein the axes of rotation of the folding prong rows are offset relative to each other in a vertical direction.

4. The crockery basket according to claim 2, wherein the axes of rotation of the folding prong rows are offset relative to each other in a horizontal direction.

5. The crockery basket according to claim 1, wherein a selected one of the holding device and a given one of the folding prong rows is mounted on at least one lateral stay defining a lateral wall of the crockery basket.

6. The crockery basket according to claim 5, wherein a bearing plate is provided as support for bearings for each of the at least two prong rows of the holding device and the bearing plate is detachably connected to the lateral wall of the crockery basket.

7. The crockery basket according to claim 6, wherein the bearing plate has a number of bearing bushes lying in a respective axis of rotation corresponding to a number of folding prong rows and the bearing bushes are formed on the bearing plate and serve to receive bearing journals lying in the axis of rotation.

8. The crockery basket according to claim 7, wherein the bearing plate has at least one stop means, which forms a stop for a holding part of one of the folding prong rows, for limiting pivoting angles thereof.

9. The crockery basket according to claim 8, wherein a stop nose is provided in the bearing plate for each folding prong row, the stop nose facilitating a fixed securement of the folding prong rows in a first pivoting position in which the prongs of each folding prong row are aligned essentially vertically.

10. The crockery basket according to claim 7, wherein the bearing plate has at least one stop that limits pivoting angles of one of the folding prong rows.

11. The crockery basket according to claim 6, wherein one bearing plate is assigned to each holding device in order to retain the folding prong rows of the holding device and limit pivoting angles.

12. The crockery basket according to claim 1, wherein the prongs of a folding prong row have a curvature such that the prongs of all of the folding prong rows lie in one line and alignment along the axis of rotation in a first pivoting position.

13. The crockery basket according to claim 1, wherein the prongs of each of the folding prong rows are spaced regularly in relation to each other and the prongs of the respective folding prong rows are arranged alternately at the same distance from each other.

14. The crockery basket according to claim 1, wherein the holding device is formed over an inner length of the crockery basket.

15. The crockery basket according to claim 14, wherein the holding device is divided over the inner length into a first and a second holding device, with at least two folding prong rows each, the folding prong rows being foldable independently of each other between different pivoting positions.

16. The crockery basket according to claim 1, wherein the crockery basket is arranged as a lower basket in a dishwasher machine.

17. The crockery basket according to claim 1, wherein the crockery basket is arranged as an upper basket in a dishwasher machine.

18. The crockery basket according to claim 1, wherein the plurality of prongs of the second prong row include a curvature portion such that the plurality of prongs of the first folding prong row and the second prong row form a flat surface of the crockery basket when the first folding prong row and the second prong row are in a horizontal position.

19. The crockery basket of claim 1, wherein the longitudinal extent has an upward facing side configured to face the plurality of different items of crockery and a downward facing side configured to face away from the plurality of different items of crockery, the upward facing side being opposite the downward facing side relative to the longitudinal extent and in the vertical direction, wherein the first axis of rotation of the first folding prong row is arranged on the upward facing side of the longitudinal extent of the wire mat of the crockery basket relative to the vertical direction, and wherein the second axis of rotation of the second folding prong row is arranged on the downward facing side of the longitudinal extent of the wire mat of the crockery basket relative to the vertical direction.

20. A dishwasher machine, comprising:

a washing container for receiving therein crockery to be washed, the washing container having an upper end and a lower end; and a crockery basket for receiving a plurality of different items of crockery for supporting of such crockery in the washing container, the crockery basket including:

a wire mat forming a bottom of the crockery basket, the wire mat having a wire with a longitudinal extent having an upward facing side configured to face the upper end of the washing container and a downward facing side configured to face the lower end of the washing container, the upward facing side being opposite the downward facing side relative to a vertical direction;

a holding device mounted on the longitudinal extent of the wire, the holding device having a plurality of prongs, the holding device being foldable between different pivoting positions and having at least two folding prong rows, each of the at least two folding prong rows being folded independently of each other between different pivoting positions, wherein a first axis of rotation of a first folding prong row of the at least two folding prong rows is arranged on the upward facing side of the longitudinal extent of the wire mat of the crockery basket relative to the vertical direction, and wherein a second axis of rotation of a second folding prong row of the at least two folding prong rows is arranged on the downward facing side of the longitudinal extent of the wire mat of the crockery basket relative to the vertical direction, and wherein the first axis of rotation and the second axis of rotation are disposed on opposite sides of the longitudinal extent of the wire mat from each other relative to the vertical direction.

21. The dishwasher machine of claim 20, wherein the first folding prong row is mounted on a first part of the longitudinal extent of the wire and the second folding prong row is mounted on a second part of the longitudinal extent of the wire, wherein the first part is different from the second part, wherein the first axis of rotation of the first folding prong row is arranged directly above the first part of the longitudinal extent of the wire relative to the vertical direction, and wherein the second axis of rotation of the second folding prong row is arranged directly below the second part of the longitudinal extent of the wire relative to the vertical direction.

22. A crockery basket for receiving a plurality of different items of crockery for handling of such crockery in a dishwasher machine, the crockery basket comprising:

a wire mat forming a bottom of the crockery basket, the wire mat having a wire with a longitudinal extent having an upward facing side configured to face the plurality of different items of crockery and a downward facing side configured to face away from the plurality of different items of crockery, the upward facing side being opposite the downward facing side relative to the longitudinal extent and in a vertical direction;

a holding device mounted on the longitudinal extent of the wire of the wire mat, the holding device having a plurality of prongs, the holding device being foldable between different pivoting positions and having at least two folding prong rows, a first folding prong row of the at least two folding prong rows being folded independently of a second folding prong row of the at least two folding prong rows between different pivoting positions, wherein a first axis of rotation of the first folding prong row is arranged on the upward facing side of the longitudinal extent of the wire mat of the crockery basket relative to the vertical direction, wherein a second axis of rotation of the second folding prong row is arranged on the downward facing side of the longitudinal extent of the wire mat of the crockery basket relative to the vertical direction, and wherein the first axis of rotation and the second axis of rotation are disposed on opposite sides of the longitudinal extent of the wire mat from each other relative to the vertical direction.

23. The crockery basket of claim 22, wherein the first folding prong row is mounted on a first part of the longitudinal extent of the wire and the second folding prong row is mounted on a second part of the longitudinal extent of the wire, wherein the first part is different from the second part, wherein the first axis of rotation of the first folding prong row is arranged directly above the first part of the longitudinal extent of the wire relative to the vertical direction, and wherein the second axis of rotation of the second folding prong row is arranged directly below the second part of the longitudinal extent of the wire relative to the vertical direction.

24. The crockery basket of claim 22, wherein the plurality of prongs of the second folding prong row include a curvature portion such that the plurality of prongs of the first folding prong row and the second folding prong row form a flat surface of the crockery basket when the first folding prong row and the second folding prong row are in a horizontal position.

* * * * *

UNITED STATES PATENT AND TRADEMARK OFFICE

CERTIFICATE OF CORRECTION

PATENT NO. : 8,651,287 B2
APPLICATION NO. : 11/658246
DATED : February 18, 2014
INVENTOR(S) : Moser et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1097 days.

Signed and Sealed this
Twenty-ninth Day of September, 2015

Michelle K. Lee

Michelle K. Lee
*Director of the United States Patent and Trademark Office*